United States Patent [19]

Auger

[11] Patent Number: 5,067,501

[45] Date of Patent: Nov. 26, 1991

[54] FLUID APPLICATOR FOR HAIR CONDITIONING

[76] Inventor: Ronald Y. Auger, 8576 St. Denis, Montreal, Quebec H2P 2H2, Canada

[21] Appl. No.: 656,981

[22] Filed: Feb. 19, 1991

[30] Foreign Application Priority Data

May 31, 1990 [GB] United Kingdom ..... 9012150

[51] Int. Cl.[5] ..... A45D 24/22

[52] U.S. Cl. ..... 132/116; 132/112; 132/212; 401/183; 222/566

[58] Field of Search ..... 132/112, 113, 114, 115, 132/116, 207, 208, 212, 270, 272, 320; 401/10, 11, 183; 222/191, 206, 212, 566, 567, 568, 570

[56] References Cited

U.S. PATENT DOCUMENTS

| | | | |
|---|---|---|---|
| 1,765,114 | 6/1930 | Turner | 222/566 |
| 2,930,061 | 3/1960 | O'Neil | 401/11 |
| 3,457,928 | 7/1969 | Kurshenoff | 132/113 |
| 4,211,247 | 7/1980 | Morganroth | 132/320 |
| 4,294,270 | 10/1981 | Cochran | 132/112 |
| 4,462,413 | 7/1984 | Schmitz | 132/113 |
| 4,495,958 | 1/1985 | Roeder | 401/183 |
| 4,617,949 | 10/1986 | Hofmann-Igl | 132/320 |
| 4,727,893 | 3/1988 | Goncalves | 132/116 |

FOREIGN PATENT DOCUMENTS 3244174 5/1984 Fed. Rep. of Germany ..... 132/320

*Primary Examiner*—John J. Wilson
*Assistant Examiner*—Frank A. LaViola
*Attorney, Agent, or Firm*—Roland L. Morneau

[57] ABSTRACT

An outlet nozzle adapted to be fixed to a substantially cylindrical hair conditioning bottle for dispensing fluid on a lock of hair comprises a hollow tubular member and a dispensing tip fluidly connected at one end of the tubular member opposite the bottle. The tubular member has two continuous longitudinal portions angularly disposed relative to each other. One of the portions is adapted to extend at an angle away from the longitudinal axis of the bottle while the other portion extends towards the axis at an angle therewith and up to a location adjacent the axis. The dispensing tip comprises a pair of flat tooth-like projections spacedly facing each other and extending from the other portion substantially in the same direction as the latter to define an archway adapted to the slidable through the hair to define the lock of hair. The other portion is provided with an aperture between the projections at the bottom of the archway for allowing the dispensing of the fluid from the bottle. The tooth-like projections are adapted to hold a portion of the lock of hair therebetween while the fluid is dispensed on the portion of the lock.

8 Claims, 2 Drawing Sheets

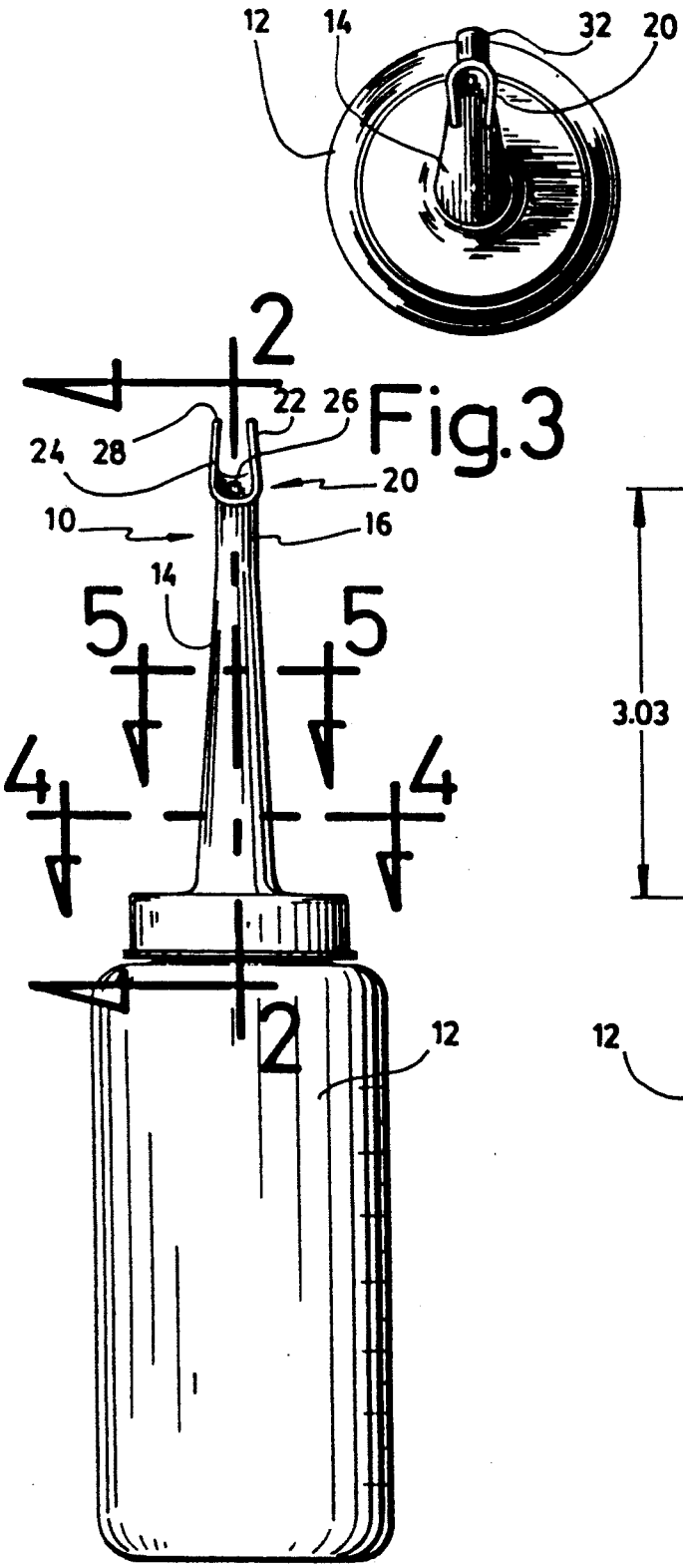
Fig.3
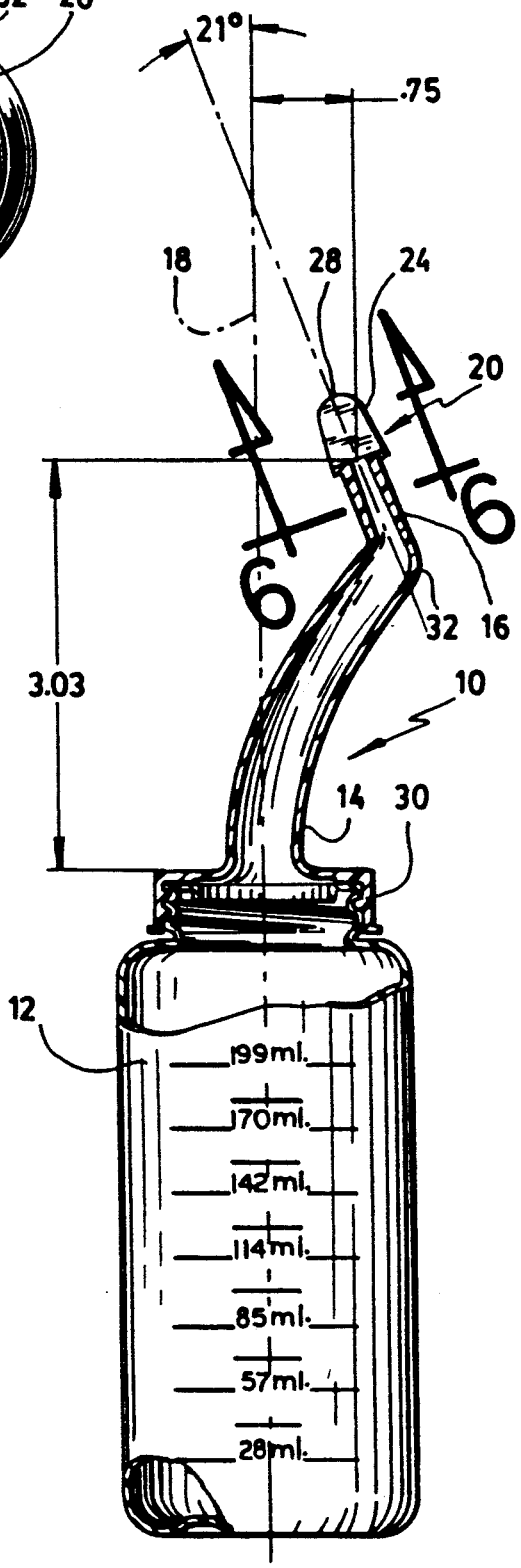
Fig.1
Fig.2

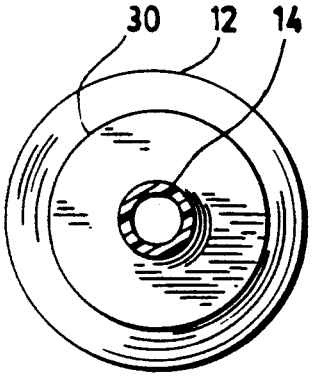
Fig.4
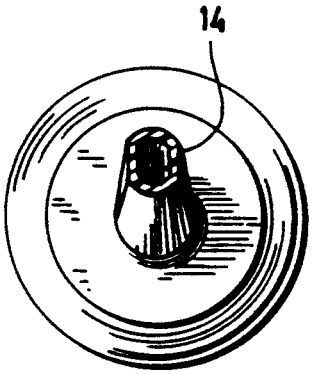
Fig.5
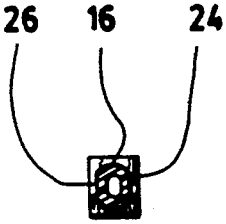
Fig.6
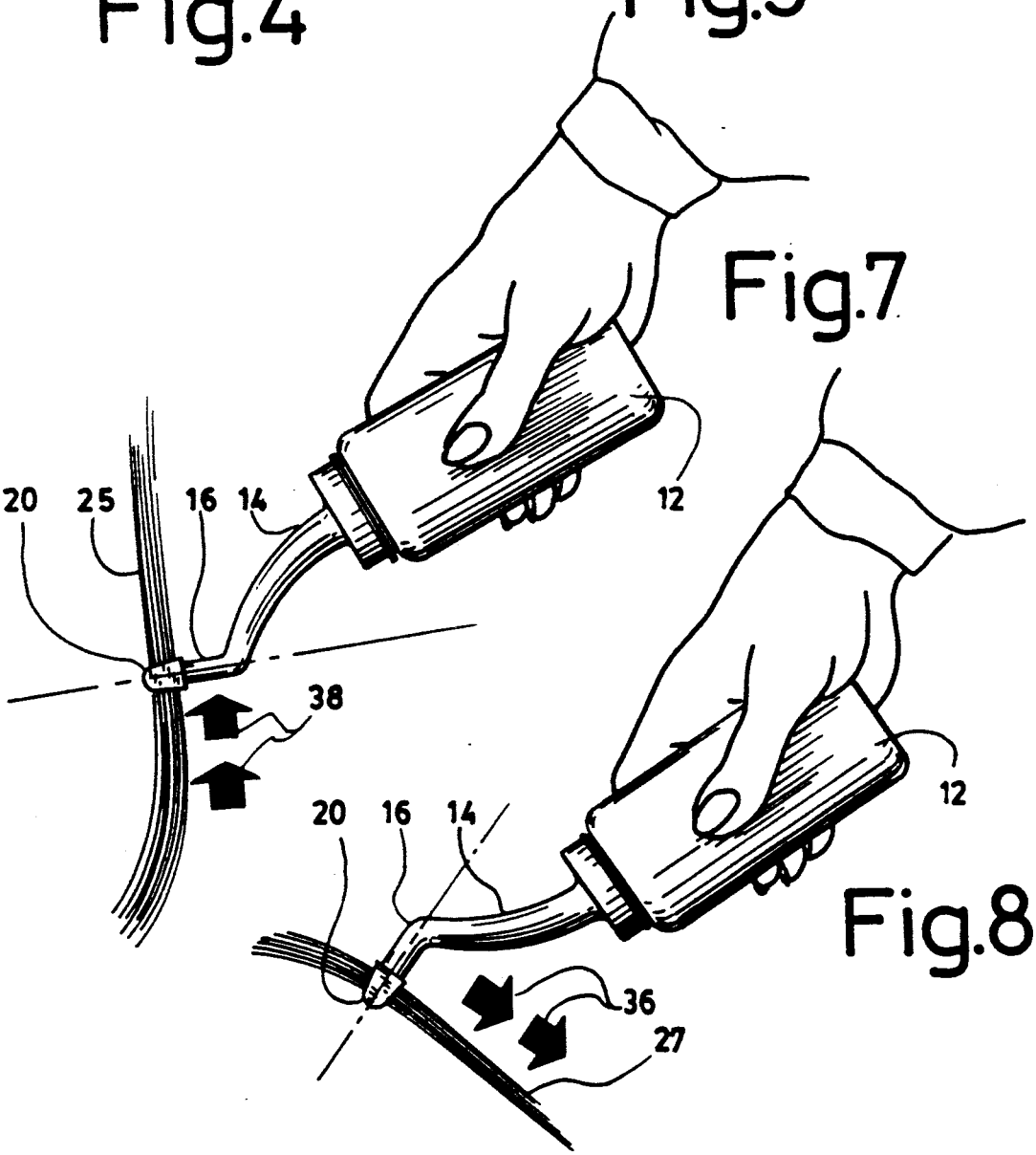
Fig.7
Fig.8

FLUID APPLICATOR FOR HAIR CONDITIONING

BACKGROUND OF THE INVENTION

1. Field of the Invention

The invention relates to a fluid applicator for hair conditioning such as tinting, streaking, highlighting or the like. It is particularly directed to a nozzle adapted to be mounted on a dispensing bottle. The nozzle is characterized by its particular angular shape and its fork-like projections for simultaneously holding a lock of hair and guiding the liquid on the lock. The liquid is dispensed in the throat of the fork-like projections.

2. Prior Art

In U.S. Pat. No. 2,295,746 the liquid, in the fountain comb is dispensed at 90 degrees from the bulb which is used as the handle. Furthermore, the liquid is dispended at the tip the teeth.

U.S. Pat. No. 2,672,875 discloses a fluid applicator which projects the liquid in the direction of the bottle used as the handle or at 90 degrees as shown in FIG. 7.

U.S. Pat. No. 3,352,623 discloses a lubricant dispenser which projects the liquid in the direction of the flexible cube which is used as the handle of the applicator.

L. Cochran in U.S. Pat. No. 4,294,270 describes a hair treating fluid applicator which projects the liquid through the tip of the teeth which provide a passage to project the liquid against the scalp of a person as seen in FIGS. 4 and 5.

A medication dispenser is described in U.S. Pat. No. 4,495,958 in which the liquid is similarly projected through the tip of each individual tooth, in which case the fluid reaches the bottom of the scalp.

SUMMARY OF THE INVENTION

The invention is directed to an outlet nozzle especially adapted to be fixed to a hair conditioning bottle for dispensing fluid on a lock of hair. The nozzle comprises a hollow tubular member and a dispensing tip member fluidly connected at one end the tubular member opposite the bottle. The tubular member has two continuous longitudinal portions angularly disposed relative to each other. One of the portion is adapted to extend at an angle away from the longitudinal axis of the bottle and the other portion extends towards the axis at an angle the width and up to a location adjacent the axis. The dispensing tip comprise a pair of flat tooth-like projections spacedly facing each other and extending from the tubular member substantially in the same direction as the adjacent portion. The tooth-like projections define an archway adapted to be slidden through the hair to define the lock of hair. The tubular member adjacent the projection is provided with an aperture in the throat of the archway for allowing the dispensing fluid from the bottle. Accordingly, the tooth-like projections are adapted to hold a portion of the lock of hair therebetween while the fluid is dispensed on this latter portion of the lock.

BRIEF DESCRIPTION OF THE DRAWINGS

FIG. 1 is an elevation front view of a nozzle and a bottle for applying hair conditioning liquid according to the invention.

FIG. 2 is a side view of the nozzle and bottle along line 2—2 of FIG. 2 with cut-out parts, FIG. 3 is a top view of the nozzle and bottle shown in FIG. 1, FIGS. 4 and 5 are cross-sectional views along line 4—4 and 5—5 of FIG. 1, FIG. 6 is a cross-sectional view along line 6—6 of FIG. 2, FIGS. 7 and 8 are two different side views of the novel liquid applicator for the two different operations.

DETAILED DESCRIPTION OF THE INVENTION

In FIGS. 1 and 2, an outlet nozzle 10 is mounted on a bottle 12 made of flexible material such as plastic. The bottle 12 is adapted to contain a hair conditioning liquid which will flow through the nozzle and when the bottle is substantially tilted as explained later. The nozzle 10 comprises two portions 14 and 16 disposed at an angle with one another. The portion 14 extends from the bottle 12 at an angle relative to the longitudinal axis 18 of the bottle. The second portion 16 is directed towards the axis 18 and extends up to a location adjacent the axis 18. The nozzle 10 is preferably tapered from the bottle up to the upper tip of the nozzle.

The top end of the tubular member is provided with a dispensing tip 20 made of pair of flat tooth-like projections 22 and 24 facing each other in spaced relationship to form a fork or an archway. The upper portion 16 of the tubular member is provided with an aperture 26 at its top end extending between the tooth-like projections 22 and 24. Both free ends 28 of the archway are rounded to smoothly follow the contour of the scalp or the base of the hair stems. The outlet nozzle 10 is generally connected to the bottle by a cap 30 which threadedly engages the open end of the bottle 12. The bottle 12 is preferably cylindrical but can also be made to taper in the direction of the nozzle 10 to allow the liquid contained to completely flow toward the nozzle when the bottle is tilted.

The apex 32 of the tubular member slightly exceeds outside the diameter of the bottle according to a preferred embodiment of the invention. Such an embodiment involves a bottle which has a diameter of about two inches so that it can be manipulated easily with the fingers of one hand and rotated about its axis 18 without the help of the other hand. The lower portion 14 has a height of about two and a quarter inches while the total height of the tubular member up to the dispensing tip member 20 is about three inches. The height of the tooth-like projections 22 and 24 is about half an inch projecting in the same direction as the portion 16 of the tubular member and are spaced from each other by a distance corresponding to the lock of hair selected. Such a selection varies with the type, texture, and length of hair of the person on which the hair conditioning liquid is applied. A dispensing tip member 20 having tooth-like projections of about half an inch are generally spaced by a distance of about one quarter to five eight inch. For a tip member 20 having a height of about three eighths of an inch, a spacing of three sixteenths to one quarter inch is sufficient. For thin and short hair, the length of the projections 22 and 24 may be selected at about three eighths of an inch and spaced by a distance of three sixteenths of an inch.

The dimension of the aperture 26 varies according to the width between the projections 22 and 24 of the archway or fork 20. For instance, in the first mentioned embodiment, an aperture 26 of about one sixteenth of an inch has been found suitable. Correspondingly smaller apertures are selected for smaller archways. Considering that the projections 22 and 24 constitute flat walls for the dispensing of the liquids, the aperture 26 is preferably elongated as shown in FIG. 6 to correspond to the plane of the tooth-like projections.

FIGS. 7 and 8 illustrate the new nozzle mounted on a flexible bottle in two different stages of the hair conditioning operation. As may be compared between FIGS. 7 and 8, the mere rotation of the bottle about its longitudinal axis by 180 represents a drastic change in the direction of the upper portion 16 of the nozzle. In FIG. 7, this position is selected for applying the fluid in a substantially vertical lock 25 while in FIG. 8, the fluid is applied to a lock 27 which is considerably more horizontal than in FIG. 7. This means that without any motion of the arm and the elbow by the hairdresser, and only by a manipulation of the fingers, it is possible to apply the fluid along various parts of the head.

Furthermore, the dispensing tip 20, forms an archway which holds and guides a lock such as 25 and 27 on which the dispensing fluid coming from the throat of the archway will be apply by compressing the bottle 12. It is pointed out that the bottle 12 could be any means which would be adapted to project the fluid in the direction of the nozzle according to the invention. A pistol-like member which would allow an easy manipulation and rotation of the nozzle could be substituted for the bottle.

In FIG. 8, the dispensing tip 20 operates in a similar manner as in FIG. 7 but glides along the arrow 36 which indicates a direction substantially different than the one shown by the arrow 38 in FIG. 7. The embodiment shown in FIG. 2 illustrates the upper portion 16 having a angle of twenty-one degrees with the axis of the bottle which means that when the the bottle is twisted by 180 degrees, the difference in the projecting angle will vary by forty-two degrees. In order to be able to move from the top of the head down to the side of the head with the minimal movement of the arm, an angle of about fifteen to twenty-five degrees is selected between the direction of the portion 16 and the axis 18.

As it may be seen from the illustrations shown in FIGS. 7 and 8, the apex 32 of the angle between portions 14 and 16 of the nozzle projects outside of the axis 18 of the bottle so as to allow a better vision by the hairdresser on the locks of hair 25 and 27 which are being conditioned. With the dimensions such as identified above, the apex 32 may be located at about one to one and a half inches from the axis 18.

It is also preferred to maintain the dispensing tip 20 at such a location so as it recedes from the axis 18. According to the dimensions of the nozzle identified above, a receding distance of about three-quaters of an inch has been found particularly suitable.

The lower portion 14 of the nozzle 10 is preferably curved to facilitate the flow of the liquid towards the dispensing tip 20. For an embodiment as identified above, the curve of the portion 14 may vary between two to four inches in radius.

The fluid applicator for hair conditioning according to the present invention is simple to contract, and easy to manipulate.

I claim:

1. An outlet nozzle adapted to be fixed to a substantially cylindrical and collapsible hair conditioning bottle for dispensing liquid on an outward surface of a lock of hair of a human scalp, said nozzle comprising a rigid hollow tubular member and a dispensing tip fluidly connected at one end of said tubular member opposite the bottle, said tubular member having two continuous longitudinal portions being angularly disposed relative to each other, one of said portions adapted to extend at an angle away from the longitudinal axis of said bottle and the other portion extending towards said axis at an angle therewith and up to a location adjacent said axis, said dispensing tip comprising a pair of flat tooh-like projections spacedly facing each other and extending from a free end of said other portion substantially in the same direction as said other portion to define an archway, said projections of said archway adapted to contact the scalp and to be slidable through the hair to define said lock of hair, said other portion being provided with an aperture between said projections and at the intersection of said other portion and the bottom of said archway for allowing the dispensing of the fluid from said bottle onto said outward surface of the lock adapted to face said other portion, said tooth-like projections adapted to hold a portion of said lock of hair therebetween while said liquid is dispensed on said outward surface of said portion of the lock.

2. An outlet nozzle as recited in claim 1, wherein said projections have rounded edges adapted to allow smooth tilting motion when contacting the scalp holding the lock.

3. An otulet nozzle as recited in claim 2, wherein said aperture has flat sides substantially parallel to the flat projections.

4. An outlet nozzle as recited in claim 2, wherein said other portion extends at an angle of about fifteen to twenty-five degrees with the axis of the bottle.

5. An outlet nozzle as recited in claim 4, wherein said one portion curves away from said axis to a distance of about one to one and a half inches.

6. An outlet nozzle as recited in claim 5, wherein said projections are recedent from said axis.

7. An outlet nozzle as recited in claim 5, wherein the one portion has a length about twice the length of the other portion.

8. In combination, a collapsible bottle adapted to contain dispensing fluid and a removably mounted nozzle on said bottle for projecting the fluid by compressing said bottle, said nozzle adapted to dispense said fluid on an outward surface of a lock of hair of a human scalp, said nozzle comprising a rigid hollow tubular member and dispensing tip fluidly connected at one end of said tubular member opposite the bottle, said tubular member having two continuous longitudinal portions being angularly disposed relative to each other, one of said portions extend at an angle away from the longitudinal axis of said bottle and the other portion extending towards said axis at an angle therewith and up to a location adjacent said axis, said dispensing tip comprising a pair of flat tooth-like projections spacedly facing each other and extending from a free end of said other portion substantially in the same direction as said other portion to define an archway, said projections of said archway adapted to contact the scalp and to be slidable through the hair to define said lock of hair, said other portion being provided with an aperture between said projections and at the intersection of said other portion and the bottom of said archway for allowing the dispensing of the fluid from said bottle onto said outward surface of the lock facing said other portion, said tooth-like projections adapted to hold a portion of said lock of hair therebetween while said liquid is dispensed on said outward surface of said portion of the lock.

* * * * *